US005081934A

United States Patent [19]

De Ro et al.

[11] Patent Number: 5,081,934

[45] Date of Patent: Jan. 21, 1992

[54] RAILWAY BOGIE WITH ARTICULATED SIDE FRAMES

[75] Inventors: Michel D. De Ro, Nivelles; Pierre Hecq, Mont-Sur-Marchienne, both of Belgium

[73] Assignee: S.A. Constructions Ferroviaires et Metalliques, Belgium

[21] Appl. No.: 444,170

[22] PCT Filed: May 11, 1988

[86] PCT No.: PCT/BE88/00014

§ 371 Date: Nov. 13, 1989

§ 102(e) Date: Nov. 13, 1989

[87] PCT Pub. No.: WO88/08802

PCT Pub. Date: Nov. 17, 1988

[30] Foreign Application Priority Data

May 13, 1987 [BE] Belgium ..... 8700527

[51] Int. Cl.[5] ..... B61F 5/38

[52] U.S. Cl. ..... 105/168; 105/169; 105/218.2; 105/187

[58] Field of Search ..... 105/3, 165, 166, 167, 105/168, 169, 218.2, 223, 187

[56] References Cited

U.S. PATENT DOCUMENTS

| | | | |
|---|---|---|---|
| 205,390 | 6/1878 | Hurd | 105/169 |
| 402,950 | 5/1889 | Maloy | 105/169 |
| 513,835 | 1/1894 | Smithman | 105/166 |
| 3,818,841 | 6/1974 | Julien | 105/187 |
| 3,974,779 | 8/1976 | Lindblom et al. | 105/165 |
| 4,362,109 | 12/1982 | Panagin | 105/169 |
| 4,459,919 | 7/1984 | Lemaire et al. | 105/169 |

*Primary Examiner*—Robert J. Oberleitner
*Assistant Examiner*—S. Joseph Morano
*Attorney, Agent, or Firm*—Sughrue, Mion, Zinn Macpeak & Seas

[57] ABSTRACT

A rail vehicle guide and support arrangement including a bogie having independent wheels, has a crossbeam fastened to a vehicle body, so as to be perpendicular to the vertical plane containing the longitudinal axis of the vehicle, in proximity to one end of the body. Two longitudinal members each equipped with at least two wheels are mounted on an articulation member carried by the crossbeam on each side of the vertical lane, and connected to each other by a brace which is mounted on a ball joint. Each longitudinal member is provided with an articulation and each is composed of a longitudinal frame member articulated to the crossbeam and extended by a directional arm which is articulated, about a substantially vertical pivot, to the longitudinal frame member and is equipped at its free end on a wheel. Each directional arm is connected to the brace by rods forming a deformable quadrilateral which ensures correct orientation of the wheels while traversing curves.

15 Claims, 4 Drawing Sheets

RAILWAY BOGIE WITH ARTICULATED SIDE FRAMES

BACKGROUND OF THE INVENTION the present invention relates to a rail vehicle guide and support arrangement consisting of a bogie having independent wheels and comprising a crossbeam or cross member fastened to a vehicle body in such a manner as to be perpendicular to the vertical plane containing the longitudinal axis of the vehicle, in proximity to one end of said body, and also comprising two longitudinal members each equipped with at least one wheel, and, in the longitudinal direction, mounted on articulation means carried by the cross member on each side of said vertical plane, in such a manner as to enable the wheels carried by the longitudinal members to follow the curves and to pass over uneven parts of the track.

Its principal application is in urban transport, particularly when the track has small radius curves or when the track infrastructure, especially for underground urban transport, as in the case of the Paris "metro", requires the use of light, compact guide and support arrangements.

Numerous rail vehicle support arrangements are already known which are able to ensure dynamic stability of these vehicles both on straight stretches and on curved parts of the track which are taken at high speed.

European Patent No. 0 060 000, which is the equivalent of U.S. Pat. No. 4,459,919, describes a rail vehicle support and guide arrangement equipped with at least four wheels mounted on a support intended to be fastened to a vehicle body in proximity to one end of said body. This arrangement consists of a crossbeam or cross member held at right angles to the vertical plane containing the longitudinal axis of the vehicle, and of two longitudinal members disposed, in the operating position, in the longitudinal direction of the body, one on each side of said vertical plane. These longitudinal members are connected together by means of a rod mounted on ball joints. They are articulated to the common cross member by pivots adapted to assume a certain inclination in a substantially vertical plane. These pivots are connected together by ball joints and a bar fastened to the cross member by a pivot perpendicular to the plane formed by the cross member and the longitudinal axis of the vehicle.

On curves the longitudinal members pivot relative to the cross member about substantially vertical pivots and form the opposite sides of a deformable parallelogram, while the cross member remains at right angles to the longitudinal axis of the vehicle body.

The rigidity of the longitudinal members nevertheless prevents the wheels carried by one and the same longitudinal member and supported on one and the same line of rail from being simultaneously oriented tangentially to said rail.

This results in considerable slippage of the flange of one or both of the two wheels carried by the longitudinal member, thus giving rise to a disagreeable noise ,and increased wear on the rails and wheels.

SUMMARY OF THE INVENTION

The present invention seeks to overcome this disadvantage. It relates to a rail vehicle guide and support arrangement consisting of a bogie having independent wheels adapted to pivot about a vertical axis and to move independently in a vertical plane on each of the lines of rails. The bogie includes a cross member fastened to a vehicle body in such a manner as to be perpendicular to the vertical plane containing the longitudinal axis of the vehicle, in proximity to one end of said body, and also two longitudinal members equipped with at least one wheel and, in the longitudinal direction, mounted on articulation means carried by the cross member on each side of said vertical plane, in such a manner as to enable the wheels carried by the longitudinal members to follow the curves and to pass over uneven parts of the track, each of the longitudinal members being composed of a longitudinal frame member articulated to the crossbeam and extended by a directional arm which is equipped at its free end with a guide wheel.

This arrangement is essentially characterized in that the longitudinal members are provided with an articulation about a vertical pivot and are articulated in regard to the directional arm about a substantially vertical pivot, each directional arm (7) being connected to the brace (17) by means of rods (19) forming a deformable quadrilateral which ensures the correct orientation of the wheels (9) in curves.

In one particular embodiment each longitudinal member has an extension extending inwardly into the bogie in a transverse direction substantially perpendicular to that of the arm and provided with articulations on which a brace is fixed.

Each directional arm advantageously carries near its free end an extension extending inwardly into the bogie in a transverse direction and having fastened to it a rod fixed to said brace.

The distance between the points at which the brace is fixed to the longitudinal member is advantageously determined in dependence on the wheelbase, the track width and the position of the articulations of the frame members to the cross member and of the directional arm in relation to the frame member.

According to one feature of the invention the ratio of the distance between the plane of the guide wheel and the articulation means fastening the rod to the extension of the directional arm, to the distance between said plane of the guide wheel and the articulation means fastening the rod to the brace is so selected that the plane of the guide wheel is substantially tangent to the line of the rail, so as to have a favorable influence on the negotiation of curves by the bogie.

According to another feature of the invention the rods are connected to the extensions of the arms by means of ball joints and to the brace by means of pivots.

One advantage of the invention consists of the fact that a pair of wheels in the arrangement of the invention, bearing on one and the same line of rail, can be simultaneously oriented tangentially to the curvature of the track. The self-centering characteristics of the guide and support arrangement are not impaired, because the directional arms and the longitudinal members are held in vertical planes strictly parallel to each other, two by two. The speeds of rotation of each of the wheels, whether or not they are driving wheels, are independent.

Other features and details of the invention will emerge in the course of the following description of the drawings accompanying the present specification, which illustrate schematically a preferred form of construction of the guide and support arrangement according to the invention, and in which:

BRIEF DESCRIPTION OF THE DRAWINGS

In these different figures the same reference numerals designate identical or similar parts.

DESCRIPTION OF A PREFERRED EMBODIMENT

Figure 1:
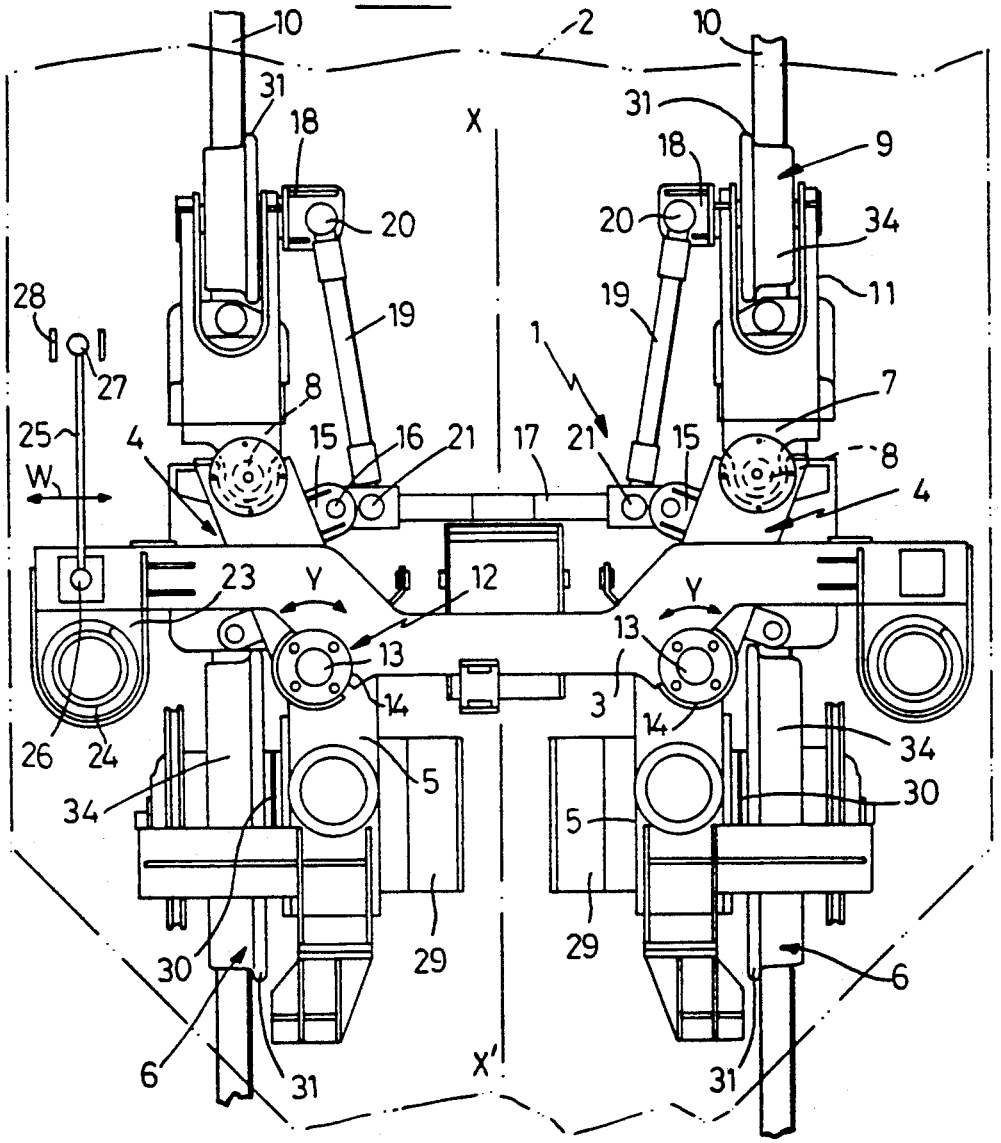
FIG. 1 is a plan view of a preferred form of construction of the arrangement according to the invention on a rectilinear track.
Figure 2:
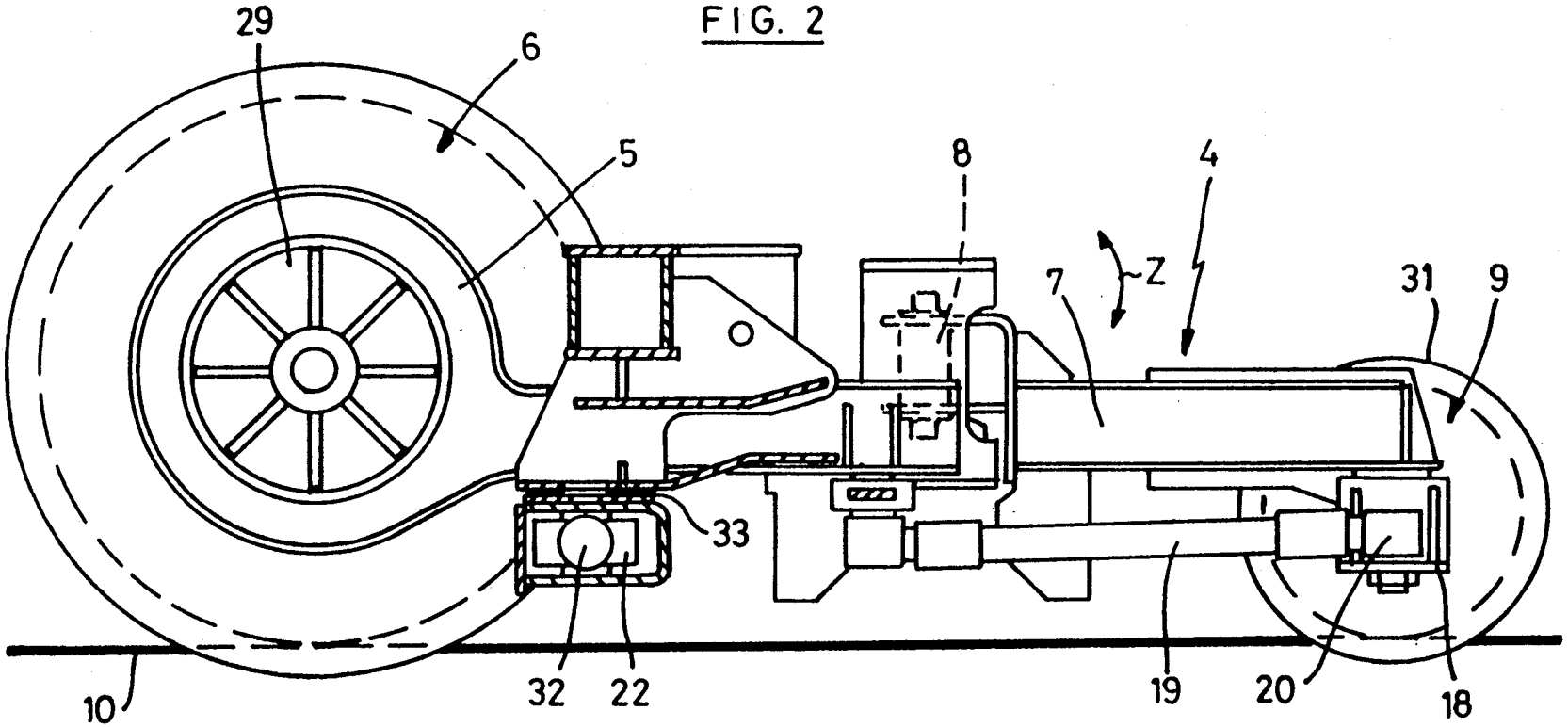
FIG. 2 is a view in side elevation of the arrangement shown in FIG. 1.

As illustrated in FIGS. 1 and 2, the guide and support arrangement, given the general reference 1, for a rail vehicle is a bogie having independent wheels and intended to carry a body or body part 2 of the rail vehicle in question. The floor is shown in dot and dash lines in said FIGS. 1 and 2, near one end of said body 2. This arrangement 1 contains a cross member 3 disposed at right angles to the vertical plane containing the longitudinal axis X X' of the body 2, and two longitudinal members 4 which, in the operating position of the arrangement, extend in the longitudinal direction of the body 2, on each side of the vertical plane containing the longitudinal axis X X'. Each longitudinal member 4 is composed of two parts articulated together. The first of these parts is a longitudinal frame member 5 carrying a wheel 6, which may be a driving wheel. This longitudinal frame member 5 is extended by a directional arm 7 articulated to the longitudinal frame member 5 about a substantially vertical pivot 8.

The directional arm 7 also carries at least one wheel 9. Each longitudinal member therefore carries a pair of wheels 6, 9 intended to follow the same line of rail, schematically represented by lines 10. The longitudinal frame member 5 preferably carries wheels 6 of large diameter, which constitute carrying wheels, which may be driving wheels. These wheels 6 are mounted on the outside near one end of the longitudinal member 4. The directional arms 7 will preferably carry wheels of small diameter, which are guide wheels 9. These guide wheels 9 are mounted in a fork 11 disposed at the free end of the directional arms 7.

On the longitudinal members 4 are mounted articulation means 12 carrying the cross member 3 in such a manner as to be able, on the one hand, to pivot in the direction of the arrows Y (FIG. 1), and on the other hand to be inclined in the direction of the arrows Z (FIG. 2). These articulation means may be pivots 13 carried by lateral bosses (not shown). These pivots 13 are adapted to assume a certain inclination, in a substantially vertical plane, around axes 14 parallel to the longitudinal axis of the cross member 3, in such a manner that the longitudinal members 4, that is to say the longitudinal frame members 5 and the directional arms 7, can be inclined in the direction of the arrows Z.

Each longitudinal frame member 5 is provided with a first extension 15 which extends towards the interior of the bogie, in a transverse direction substantially at right angles to that of a part of the longitudinal member 4 which joins the pivot 13 to the pivot 8. According to a preferred embodiment of the invention these extensions 15 serve to fasten, by means of an articulation 16, a brace 17 connecting the longitudinal members 4 together.

Near its free end each directional arm 7 carries a second extension 18 which extends towards the interior of the bogie in a direction perpendicular to the arm 7. On this second extension 18 is articulated, by means of a ball joint 20, a rod 19 fastened to the brace 17 with the aid of a ball joint 21.

The directional arms 7, the second extensions 18, the rods 19 and the brace 17 form four bar linkages, which secure the directional arms 7 to the longitudinal members 4.

When negotiating a curve the guide wheels 9 move the directional arms 7 to the left or right so as to follow the curvatures of the rail 10, while being oriented tangentially to said rail 10. These deflections of the directional arms 7 entail a pivoting movement of the longitudinal frame members 5 in relation to the cross member 3, around the substantially vertical pivots 13.

These pivots 13 can in addition be inclined, in a substantially vertical plane, around axes 14 parallel to the longitudinal axis of the cross member 3, in such a manner that the longitudinal frame members 5 and the directional arms 7 can in turn be inclined in the direction of the arrows Z and ensure permanent contact between the wheels 6, 9 and the track whatever the variations of level of the lines of rails 10, as described in European Patent No. 0 060 000.

The brace 17 carrying the articulations 16, which connect it by means of the rods 19 to the extensions 18 of the directional arms 7, forms together with the cross member 3 and the frame members 5 a deformable quadrilateral which ensures the correct orientation of the wheels 6 relative to the rail 10. The brace 17 assumes a horizontal position when the lines of rail 10 are at the same level. This brace 17 is substantially parallel to the crossbeams 3 on straight 3 lines and then extends at right angles to the two longitudinal members 4.

When the track assumes a curvature with a constant cant, it is found that the directional arms 7, which through their deflection relative to a predetermined direction give rise to the pivoting of the longitudinal members 4 relative to the cross member 3, themselves pivot, relative to the longitudinal frame members 5, about the pivots 8 because of the existence of the four bar linkage which fastens the latter to the rods 19 and to the brace 17.

The pivoting of the directional arms 7 relative to the longitudinal frame members 5 makes it possible to ensure the correct simultaneous orientation, tangentially to the curvature of the line of rail 10 supporting them, of the wheels carried by the same longitudinal members.

The longitudinal members 4 constitute levers which can at one and the same time pivot and be inclined in relation to the cross member 3 through the action of the directional arms 7.

Figure 3:
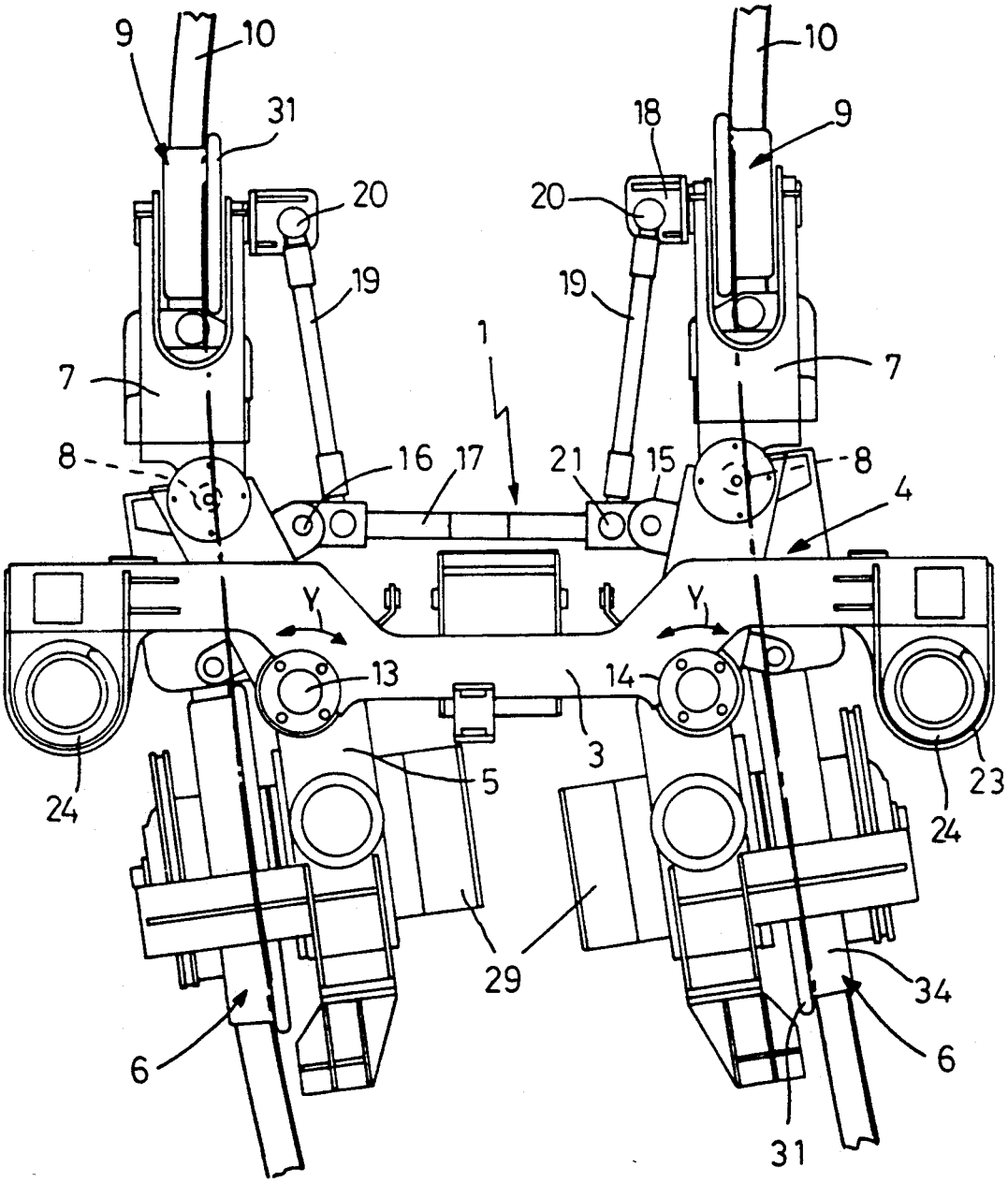
FIG. 3 is a plan view similar to that in FIG. 1, showing the arrangement according to the invention negotiating a curve in a railway track.

In the particular embodiment illustrated in FIG. 3 the pivots 13, about which the longitudinal members 4 are pivotable, are articulated on the one hand to a bar 22 about axes 14 fastened to the cross member 3 by means of ball joints. This bar 22, which is provided with a vertical pivot 33 fastened to the cross member 3, holds the axes of the pivots 13 of the longitudinal members 4 in substantially vertical planes, while allowing their inclination in said planes.

The cross member 3 is provided at each end with a lateral boss 23 which serves as support point for means connecting the cross member 3 to the floor of the body 2. These means comprise in known manner a coil spring 24, one end of which bears against the lateral boss 23 while its opposite end bears against the floor of the body 2. A rod 25, provided at one end with a first ball joint 26 fastened to the cross member 3 and at its other end with a second ball joint 27 fastened to a lug 28 fixed to the floor of the body 2, holds the cross member substantially perpendicular to the longitudinal axis of the body, while permitting a lateral displacement, in the direction of the arrows W, of the cross member 3 relative to the body 2. This lateral displacement is limited. Stop members carried by the cross member 3 and by the body 2 limit the lateral displacement of the cross member and limit the compression of the coil springs 24.

Each large diameter wheel 6 can be connected individually to a monobloc motor and reduction gear unit 29 fastened to the longitudinal frame member 5, the wheel being fixed on the output shaft 30 of said unit.

The guide and support arrangement forming the object of the present invention may be provided with auxiliary equipment such as motors, disc brakes, magnetic shoe rail brakes, antiderailment stops, and so on.

The combination of a directional arm 7 and a longitudinal frame member 5 fastened to one another by the four bar linkage enables the arrangement according to the invention to negotiate very tight bends, because it enables the wheels to be oriented tangentially to the curvature of the track. The slipping of the flanges 31 against the rails 10 is thus avoided. The adjustment of the length of the rods 19 and the selection of the points at which they are fastened to the extensions 18 of the directional arms 7 and to the brace 17 permit preadjustment of perfect parallelism of the guide wheels 9 or compensation for wear through a certain degree of toe-in or convergence.

This arrangement makes it possible to achieve self-centering of the vehicle with the aid of a frustoconical shape of the tyres 34 of the wheels 6, 9.

This arrangement also makes it possible in addition to retain the numerous advantages already mentioned in European Patent No. 00 060 000. Its weight is low. Its small dimensions make it possible to reduce the height of the vehicle floor relative to the track, and thus to improve access to said vehicle and to reduce the clearance gauge.

Figure 4:
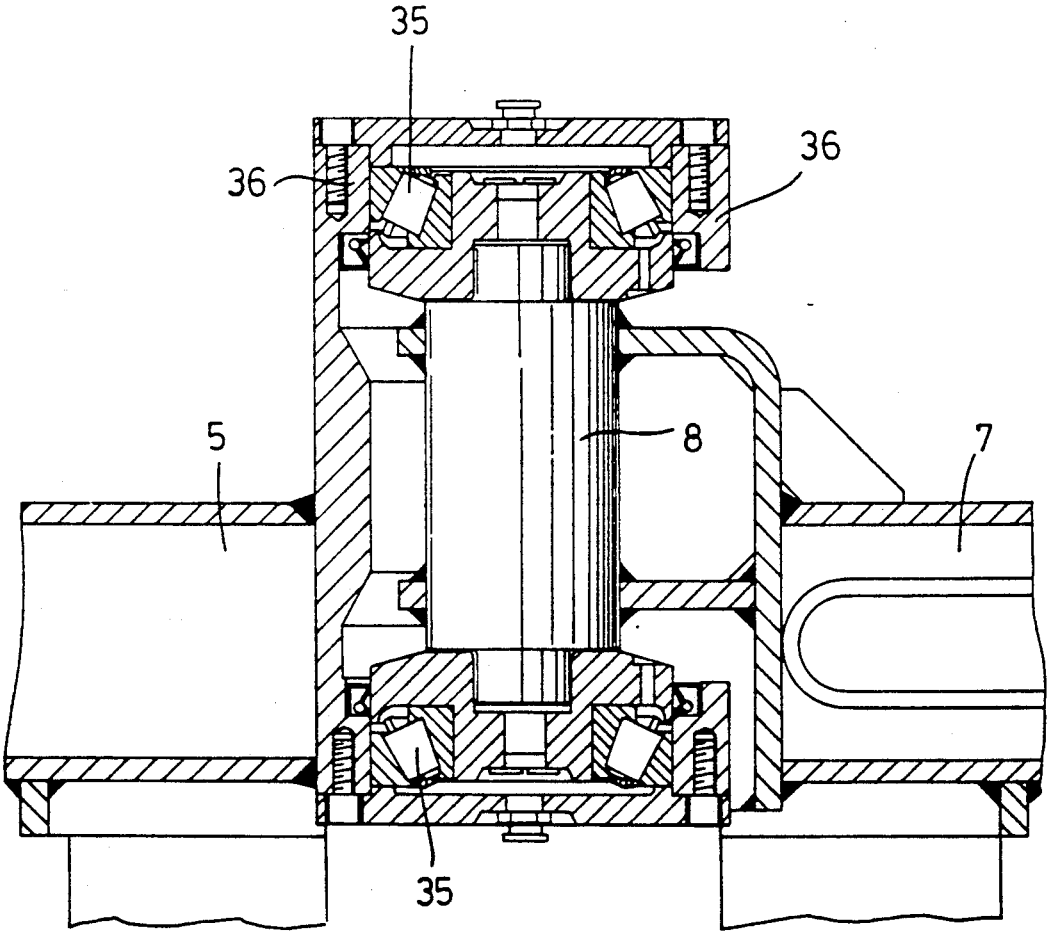
FIG. 4 is a detail view in side elevation of the articulation of the directional arm to the support beam in the longitudinal members.

A view in longitudinal section of the pivot 8 is shown in FIG. 4. The pivot 8 is supported by two conical roller bearings 35 whose casings 36 are mounted on the longitudinal frame members 5.

The arrangement is deformed kinematically without showing constraint or restoring forces. Consequently, the distribution of loads between the wheels 6, 9 is practically independent of external factors such as cant, unevenness of the track and movements of the vehicle body. Dynamic stability is also improved and the risk of derailment is reduced. Furthermore, less noise is generated and there is less wear on wheels and rails on the curves of the track.

It is obvious that the invention is not restricted to the details described above for the achievement of the pivoting and inclination of the longitudinal members 4, and that many modifications may be made to these details without departing from the scope of the invention defined by the appended claims.

The longitudinal members 4 may have a different shape from that shown in FIG.s 1, 3 and 4, and they may for example be rectilinear. The wheels 6, 9 are then mounted on the same side of the longitudinal member 4.

Instead of each being articulated to the cross member 3 by means of a pivot 13, the longitudinal members 4 may be articulated to the cross member 3 by a ball joint (not shown) carried by said cross member 3. The longitudinal members 4 must then be held in place by a ball joint 32 fixed to the bar 22, which is fastened to the cross member 3 by a substantially vertical pivot 33 in the operating position of the arrangement, or by a third ball joint.

What is claimed is:

1. A rail vehicle guide and support arrangement including a bogie having independent wheels and comprising:

a cross beam (3) fastened to a vehicle body (2) so as to be perpendicular to a vertical plane containing the longitudinal axis (X X') of the vehicle, in proximity to one end of said body (2), two longitudinal members (4) each having at least first and second wheels (6,9), and first articulation means for articulating said longitudinal members;

wherein said longitudinal members, in the longitudinal direction are mounted on said first articulation means (12) carried by said crossbeam (3) on each side of said vertical plane, so as to enable said at least first and second wheels (6,9) carried by the longitudinal members (4) to follow curves and to pass over uneven parts of a track; and wherein said longitudinal members (4) have a second articulation means;

each of said longitudinal members comprising a longitudinal frame member (5) articulated to the crossbeam (3) about said first articulation means and extended by a directional arm (7) which is articulated about said second articulation means, comprising a substantially vertical pivot (8), to the longitudinal frame member (5) and which has at its free end said second wheel (9), each directional arm (7) being connected to a brace (17) by means of a rod (19) to form a deformable quadrilateral which ensures a correct orientation of the wheels relative to a rail.

2. An arrangement according to claim 1, wherein each longitudinal frame member has a first extension extending inwardly into the bogie in a transverse direction, the first extensions being connected to each other by said brace fixed thereto by third articulation means (16), and wherein each directional arm (7) has a second extension (18) extending inwardly into the bogie in a transverse direction and having a rod (19) fastened thereto and fixed to said brace (17).

3. The arrangement according to claim 2, wherein the ratio of the distance between a plane of said second wheel (9) and fourth articulation means (20), fastening each rod (19) to said second extension (18) of each directional arm (7), to the distance between said plane of said second wheel (9) and fifth articulation means, (21) fastening said rod (19) to said brace (17), is selected so that the plane of said second wheel is substantially tangent to the line of the rail so as to enable the bogie to negotiate curves of the track.

4. The arrangement according to claim 2, wherein at least one of a degree of convergence of said second wheels (9) and a negative turning radius is obtained through the second extensions (18) of the directional arms (7) and said longitudinal frame members (5), and a fastening of the rods (19) on said brace (17).

5. The arrangement according to claim 1, wherein said first articulation means (12) comprise pivots (13) adapted to incline in a substantially vertical plane in an operating position of the arrangement, said pivots being connected together by a bar (22) which is articulated to said pivots (13) and which is fastened to the crossbeam (3) by a substantially vertical pivot (33).

6. A rail vehicle guide and support arrangement including a bogie having independent wheels and comprising:

a crossbeam (3) fastened to a vehicle body (2) so as to be perpendicular to a vertical plane containing the longitudinal axis (X X') of the vehicle, in proximity to one end of said body (2), two longitudinal members (4) each having at least first and second wheels (6,9), and first articulation means for articulating said longitudinal members;

wherein said longitudinal members, in the longitudinal direction, are mounted on said first articulation means (12) carried by said crossbeam (3) on each side of said vertical plane, so as to enable said at least first and second wheels (6,9) carried by the longitudinal members (4) to follow curves and to pass over uneven parts of a track; and wherein said longitudinal members (4) have a second articulation means;

each of said longitudinal members comprising a longitudinal frame member (5) articulated to the crossbeam (3) about said first articulation means and extended by a directional arm (7) which is articulated about said second articulation means, comprising a substantially vertical pivot (8), to the longitudinal frame member (5) and which has at its free end said second wheel (9);

wherein each longitudinal member (4) has a first extension (15) extending inwardly into the bogie in a transverse direction substantially perpendicular to that of said arm (7) and provided with third articulation means having a brace (17) fixed thereto; and wherein said brace (17) is connected by rods (19) to a second extension (18) of each directional arm (7), and forms with said crossbeam (3) and said frame members (5) a deformable quadrilateral ensuring correct orientation of said wheels (6) relative to a rail (10).

7. The arrangement according to claim 6, wherein said crossbeam (3) is divided into at least two parts adapted to pivot relative to each other about the longitudinal axis of said crossbeam (3).

8. The arrangement according to claim 6, wherein each end of said crossbeam (3) carries an additional pivot (13) on which each longitudinal member (4) is mounted, so that said each longitudinal member can simultaneously pivot about a substantially vertical axis and incline in a substantially vertical plane in an operating position in the arrangement.

9. The arrangement according to claim 6, wherein said longitudinal members (4) are each articulated to said crossbeam (3) and connected by a ball joint (32) to a bar (22) which is fastened to said crossbeam (3) by an additional substantially vertical pivot (33) in an operating position of the arrangement.

10. The arrangement according to claim 6, wherein said first articulation means (12) comprises additional pivots (13) adapted to incline in a substantially vertical plane in an operating position of the arrangement, said additional pivots being connected together by a bar (22) which is articulated to said additional pivots (13) and which is fastened to the crossbeam (3) by an additional substantially vertical pivot (33).

11. The arrangement according to claim 10, wherein said longitudinal members (4) are mounted on said pivots (13) connected together by a rod and connected to the common crossbeam (3) by ball joints so as to enable said longitudinal members (4) to pivot about their longitudinal axis.

12. The arrangement according to claim 6, wherein said rods (19) are connected to said first extension (15) of each arm (7) by said third articulation means (16) and to said brace (17) by additional pivots (21).

13. The arrangement according to claim 6, wherein at least one of a degree of convergence of said second wheels (9) and a negative turning radius is obtained through the second extensions (18) of the directional arms (7) and said longitudinal frame members (5), and the fastening of the rods (19) on said brace (17).

14. A rail vehicle guide and support arrangement including a bogie having independent wheels and comprising:

a crossbeam (3) fastened to a vehicle body (2) so as to be perpendicular to a vertical plane containing the longitudinal axis (X X') of the vehicle, in proximity to one end of said body (2).

two longitudinal members (4) each having at least first and second wheels (6,9), and first articulation means for articulating said longitudinal members;

wherein said longitudinal members, in the longitudinal direction, are mounted on said first articulation means (12) carried by said crossbeam (3) on each side of said vertical plane, so as to enable said at least first and second wheels (6,9) carried by the longitudinal members (4) to follow curves and to pass over uneven parts of a track; and wherein said longitudinal members (4) have a second articulation means;

each of said longitudinal members comprising a longitudinal frame member (5) articulated to the crossbeam (3) about said first articulation means and extended by a directional arm (7) which is articulated about said second articulation means, comprising a substantially vertical pivot (8), to the longitudinal frame member (5) and which has at its free end said second wheel (9);

wherein each longitudinal member (4) has a first extension (15) extending inwardly into the bogie in a transverse direction substantially perpendicular to that of said arm (7) and provided with third articulation means having a brace (17) fixed thereto; and wherein each directional arm (7) carries nears its free end a second extension (18) extending inwardly into the bogie in a transverse direction and having a rod (19) fastened thereto and fixed to said brace (17).

15. The arrangement according to claim 4, wherein the ratio of the distance between a plane of said second wheel (9) and fourth articulation means (20), fastening said rod (19) to said extension (18) of said directional arm (7), to the distance between said plane of said second wheel (9) and fifth articulation means, (21) fastening said rod (19) to said brace (17), is selected so that the plane of said second wheel is substantially tangent to the line of the rail so as to enable the bogie to negotiate curves of the track.

* * * * *